United States Patent [19]

Jennerjahn

[11] 3,944,150

[45] Mar. 16, 1976

[54] APPARATUS AND A METHOD FOR SLITTING AND WINDING ELONGATED SHEETS OF MATERIAL INTO ROLLS

[75] Inventor: Brian M. Jennerjahn, Hartford City, Ind.

[73] Assignee: Phylpat, Inc., Hartford City, Ind.

[22] Filed: July 18, 1974

[21] Appl. No.: 489,764

[52] U.S. Cl. ..... 242/56.2; 242/66

[51] Int. Cl.[2] ..... B65H 34/02

[58] Field of Search ..... 242/66, 56 R, 56.2

[56] References Cited

UNITED STATES PATENTS

| | | | |
|---|---|---|---|
| 1,131,146 | 3/1915 | Langston | 242/56.2 |
| 1,465,964 | 8/1923 | Cameron | 242/66 X |
| 1,827,802 | 10/1931 | Sieg | 242/66 |
| 1,831,201 | 11/1931 | Sieg | 242/66 |
| 2,364,888 | 12/1944 | Aycock | 242/66 X |
| 3,104,072 | 9/1963 | Doven | 242/56.2 X |

*Primary Examiner*—Edward J. McCarthy

[57] ABSTRACT

An apparatus and a method are provided for the slitting and the rolling of elongated sheets of material. The apparatus includes a pair of parallel spaced supporting rollers, a mandrel longitudinally disposed upon both of the supporting rollers, a riding roller being longitudinally disposed upon the mandrel and being guided for movement away from the mandrel, drive means rotating one of the supporting rollers at a predetermined speed and providing predetermined rotational torque to the other supporting roller and to the riding roller, and rider forcing means separately and adjustably forcing each end of the riding roller toward the mandrel.

The apparatus also includes a cylindrically shaped slitting drum having a plurality of longitudinally spaced circumferential grooves thereon and a plurality of disc-shaped slitting knives being mounted on a knife-mounting shaft for movement into meshing engagement with the slitting grooves and for movement into resilient operative contact with one side of each of the grooves.

The method includes placing a mandrel upon a pair of supporting rollers which are in parallel and longitudinal supporting relationship thereto, securing one end of the material to the mandrel, moving a riding roller into longitudinal surface contact with the mandrel distal from the supporting rollers, rotating the first supporting roller at a predetermined speed in the direction that draws the material between the first supporting roller and the mandrel, applying a predetermined rotational torque to the other supporting roller in the direction that provides tensioning of the sheet material on the mandrel, applying a predetermined rotational torque to the riding roller in the direction that provides tensioning of the sheet material on the mandrel, and separately and adjustably urging both ends of the riding roller into contact with the material being wound on the mandrel.

31 Claims, 14 Drawing Figures

FIG.1
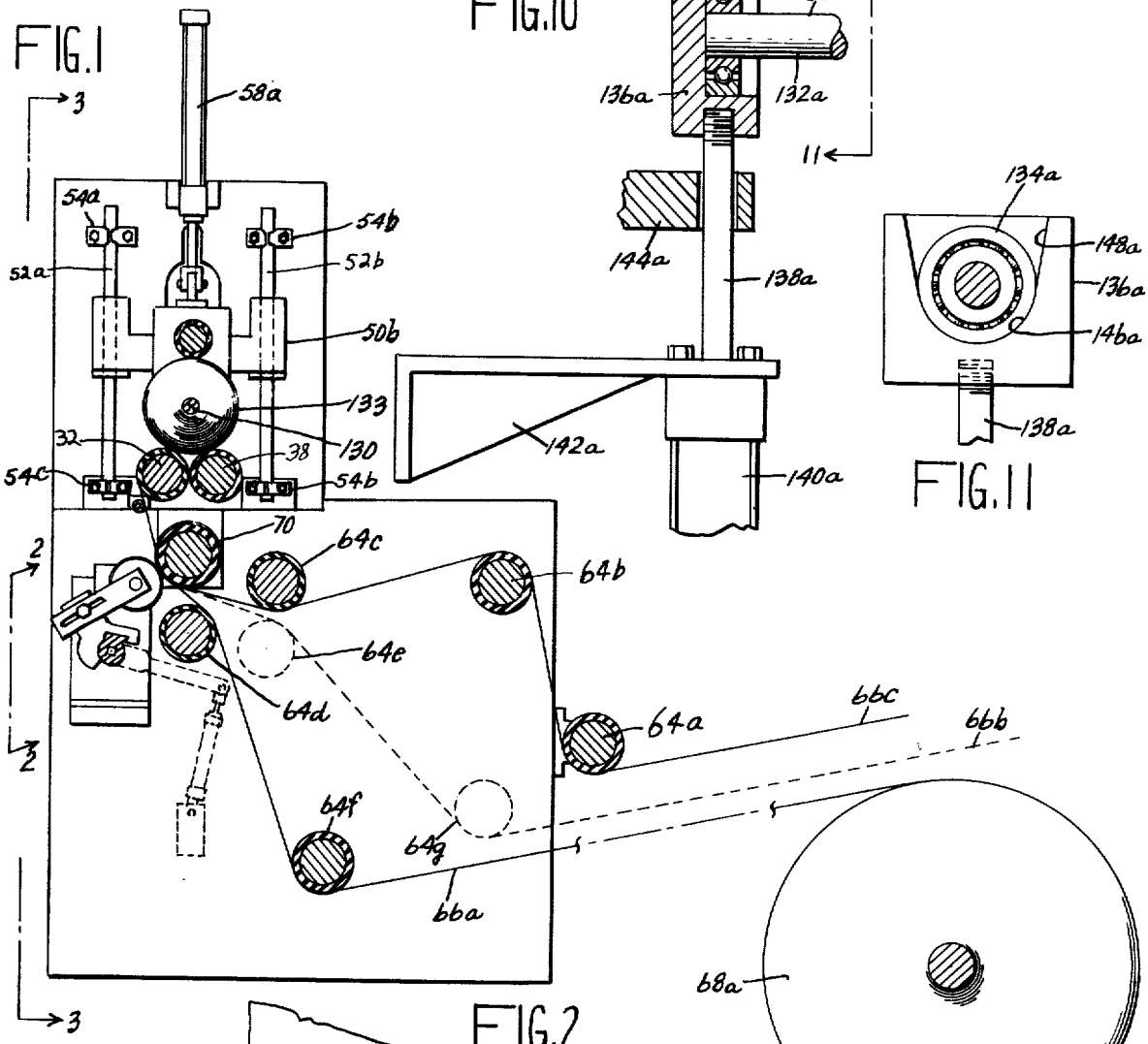
FIG.10
FIG.11
FIG.2
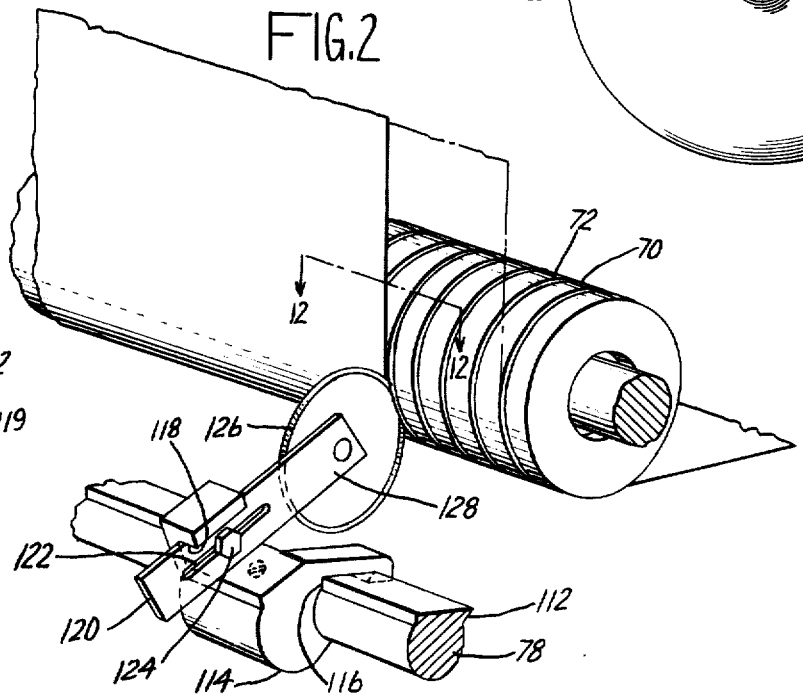
FIG.12
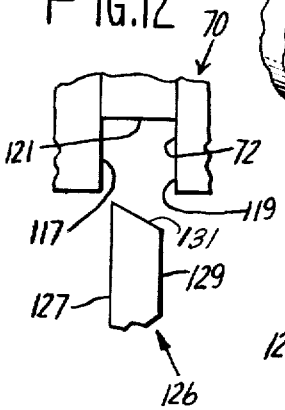

APPARATUS AND A METHOD FOR SLITTING AND WINDING ELONGATED SHEETS OF MATERIAL INTO ROLLS

BACKGROUND OF THE INVENTION

1. Field of the Invention

This invention relates generally to an apparatus and a method for slitting and for rolling elongated sheets of material, and more particularly to an apparatus and a method for controlling the uniformity and the density of the rolled material.

2. Description of the Prior Art

It has been common practice in prior art to feed paper from a wide payoff roll through a slitting mechanism and then to rewind the slitted strips of paper onto a mandrel.

The mandrel onto which the slitted paper is to be wound is customarily supported on a pair of supporting rollers and retained upon the supporting rollers by a riding roller disposed longitudinally thereupon. It has been common practice to drive all three of these rollers at constant peripheral speed by connecting them to a common drive source by sprockets and roller chains. In some cases, rotational torque to the second supporting roller and to the riding roller has been applied with friction clutches driven from a common drive. It has also been common practice to use weights, placed upon the riding roller mechanism, to urge the riding roller into contact with the mandrel, the purpose being to adjust the density of the roll being made.

There have been two deficiencies in apparatus built according to prior art. One of these deficiencies is that means for separately and adjustably urging the riding roller toward or away from the mandrel has not been provided. Thus when winding paper stock which varies in thickness from one edge to another, the roll becomes larger in diameter at one end than at the other with the result that the material tends to telescope off of the end of the roll. The other deficiency in prior art is that insufficient provision has been made for controlling the density of the rolled material. That is, the driving of the three rollers by sprockets, roller chain, and friction clutches has not provided for applying a reliable, repeatable, measurable and predetermined rotational torque to the second supporting roller and to the riding roller.

The present invention overcomes the limitations of prior art by providing means for individually and manually controlling the resilient forcing of both ends of the riding roller toward or away from the mandrel, thereby adding to or partially counterbalancing the weight of the riding roller. The present invention also overcomes the torque transmitting inaccuracy and indeterminability of friction clutches, and instead provides separate, predetermined, measurable, and manually adjustable rotational torque to the second supporting roller and to the riding roller so that the paper may be selectively tensioned between the respective rollers and so that the density of the roll can more effectively be controlled.

SUMMARY OF THE INVENTION

In accordance with the broader aspects of this invention, there is provided an apparatus and a method for slitting elongated sheets of paper and for winding the slitted paper into rolls. The apparatus includes a pair of parallel disposed supporting rollers being rotatably mounted. A mandrel is mounted in longitudinal supporting relationship to the two supporting rollers and is guided for movement orthogonally from the plane through the axes of the supporting rollers. A riding roller is longitudinally disposed upon the mandrel, distal from the supporting rollers and in the plane of movement of the mandrel, and is guided for movement from the mandrel in the aforesaid plane.

A hydraulic system is provided for the rotational driving of the first and second supporting rollers and the riding roller. The hydraulic drive means includes three hydraulic motors, one being attached to each of the rollers. The motor which is attached to the first supporting roller is provided with pressurized fluid at a predetermined fluid flow rate so that the first supporting roller rotates at a predetermined rotational speed. Pressurized fluid is supplied to the motor which is attached to the second supporting roller, at a flow rate sufficient to rotate the second supporting roller at a rotational speed at which the peripheral velocity of the second supporting roller would be greater than the peripheral velocity of the first supporting roller; but an adjustable pressure relief valve is provided to limit the rotational torque of this second fluid motor and to bypass excess fluid and a pressure gauge is provided at the relief valve to indicate magnitude of the rotational torque. Thus the second supporting roller rotates at a speed wherein the peripheral speed of the second supporting roller is substantially equal to that of the first supporting roller and the paper is tensioned around the mandrel intermediate of the two supporting rollers. In like manner an excess of fluid is furnished to the motor driving the riding roller and this fluid is furnished at a limited and a manually adjustable pressure magnitude so that the peripheral speed of the riding roller will also be substantially equal to that of the first supporting roller and the paper will be tensioned around the mandrel between the second supporting roller and the riding roller.

The aforesaid guiding of the riding roller for movement from the mandrel includes a pair of pneumatic cylinders which are connected to a source of pressurized air. Intermediate of the source of pressurized air and the pneumatic cylinders, control means is provided to separately and adjustably control the pressure magnitude of the air being supplied to the pneumatic cylinders and the resilient forcing of the riding roller toward or away from the mandrel and the roll of paper thereupon, thereby adding to or subtracting from the gravitational or initial forcing of the riding roller toward the supporting rollers.

The method includes individually and selectively adjusting the rotational torque of the second supporting roller and the riding roller. The method also includes individually and manually adjusting air pressures resiliently urging the ends of the riding roller toward or away from the mandrel and the roll of paper thereupon.

It is an object of this invention to provide an apparatus for uniformly rolling an elongated sheet of material on a mandrel.

It is another object of this invention to provide a method for adjustably controlling the density of the roll.

It is still another object of this invention to provide an apparatus for slitting and for winding elongated sheets of material in which a mandrel is rotatably mounted between three rollers, one of the rollers is rotated at a predetermined speed, and the rotational torque of two of the rollers is separately and manually adjustable and measurable.

It is still a further object of this invention to provide an apparatus for the slitting and winding of elongated sheets of paper in which a mandrel is supportably mounted between three rollers and one of the rollers is held in contact with the roll of material being formed by separate and manually adjustable forces at both ends of the one roller.

The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWINGS

In the drawings:

FIG. 1 is a cross-section of a side elevation of the apparatus taken substantially as shown by view line 1—1 of FIG. 3;

FIG. 2 is an enlarged perspective view of the slitting mechanism taken substantially as shown by view line 2—2 of FIG. 1;

FIG. 10 is a partial and enlarged front elevation taken the same as the FIG. 6 illustration, showing the mechanism for supportably guiding one end of the mandrel;

FIG. 11 is a partial end view of the mechanism of FIG. 10 taken as shown by view line 11—11 of FIG. 10;

FIG. 12 is a partial and enlarged view of the slitting drum and one of the slitting knives, taken substantially as shown by view line 12—12 of FIG. 2, showing an enlarged detail of one of the slitting grooves;

DESCRIPTION OF THE PREFERRED EMBODIMENT

Figure 3:
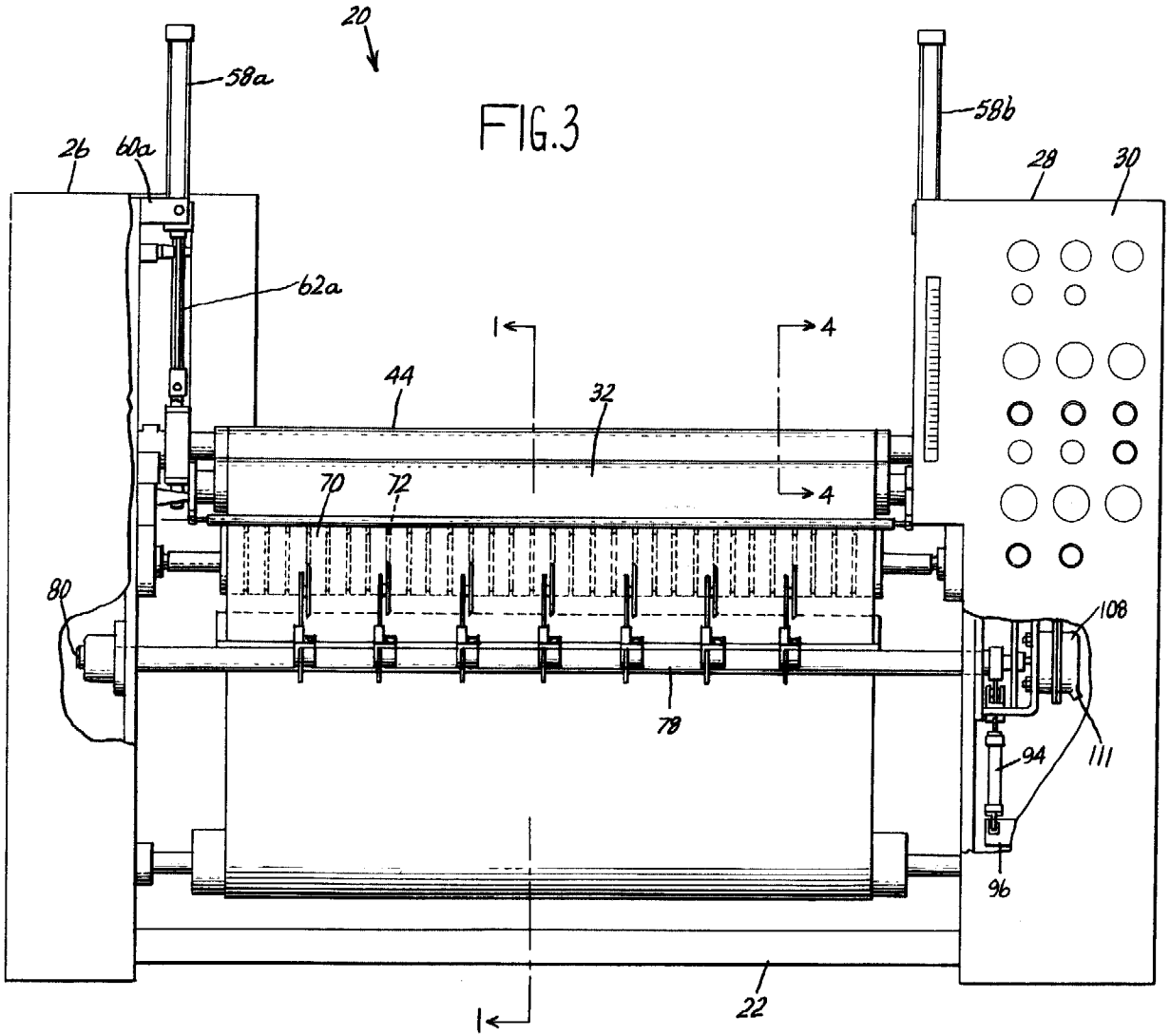
FIG. 3 is a front elevation of the apparatus taken substantially as shown by view line 3—3 of FIG. 1, but with the mandrel and the roll of paper removed.
Figure 6:
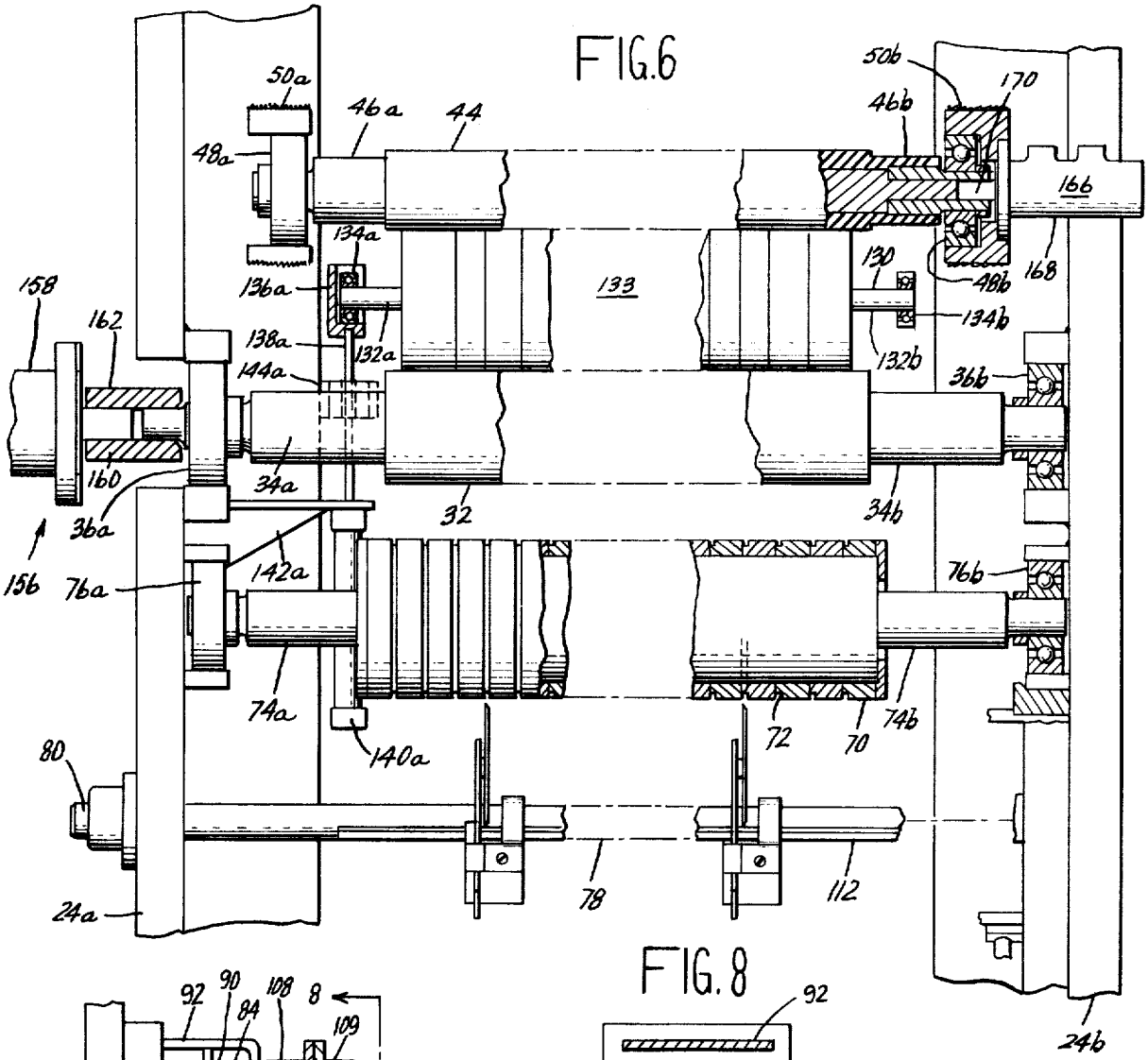
FIG. 6 is a partial front elevation, taken the same as the FIG. 3 illustration, but with the enclosing cabinets and the sheet of material removed to more clearly show the apparatus.

Referring now to FIGS. 1, 3 and 6, a paper slitting and rolling apparatus 20 includes a frame 22 having a pair of parallel spaced frame members 24*a* and 24*b*, a first enclosing cabinet 26 covering the outer extremity of the frame member 24*a* and a second enclosing cabinet 28 covering the frame member 24*b* and including a control panel 30.

Referring now to FIGS. 1 and 6, the apparatus 20 includes a first supporting roller 32 having ends 34*a* and 34*b* which are supported in the frame members 24*a* and 24*b* respectively by a pair of bearings 36*a* and 36*b*, a second supporting roller 38 like roller 32 having ends 40*a* and 40*b* (not shown) which are supported respectively in the frame members 24*a* and 24*b* by a pair of bearings 42*a* and 42*b* (not shown) like bearings 36*a* and 36*b* and a riding roller 44.

Figure 4:
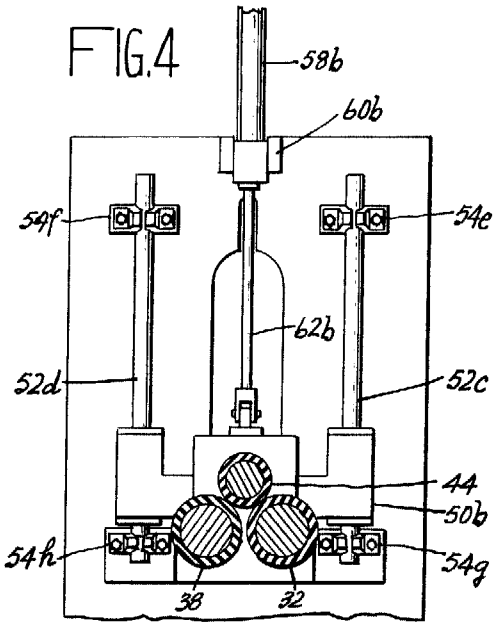
FIG. 4 is a partial cross-section of the apparatus taken as shown by view line 4—4 of FIG. 3.

Referring now to FIGS. 1, 4 and 6, the riding roller 44 includes ends 46*a* and 46*b* which are rotatably mounted in a pair of bearings 48*a* and 48*b* (FIG. 6) which are in turn receivably mounted into a pair of riding roller heads 50*a* and 50*b*. The riding roller head 50*a* (FIG. 1) is slidably mounted for vertical movement on a pair of guide rods 52*a* and 52*b*, and the riding roller head 50*b* (FIG. 4) is slidably mounted for vertical movement upon a pair of guide rods 52*c* and 52*d*. The upper ends of the guide rods 52*a* and 52*b* (FIG. 1) are mounted to the frame member 24*a* by a pair of mounting blocks 54*a* and 54*b*. The lower ends of the guide rods 52*a* and 52*b* are attached to the frame member 24*a* by a pair of mounting blocks 54*c* and 54*d*. In like manner, the riding roller head 50*b* is slidably attached to the guide rods 52*c* and 52*d*; and the guide rods 52*c* and 52*d* are mounted to the frame member 24*b* by four mounting blocks 54*e* – 54*h*.

Thus the riding roller 44 is guided for rectilinear movement in a plane transverse to and bisecting a plane through the axes of the supporting rollers 32 and 38; although, the only requirement for satisfactory operation is that the riding roller 44 be maintained angularly disposed around the longitudinal axis of a mandrel and a roll of paper thereon by less than 180° from either of the supporting rollers 32 or 38 so that the roll of paper will be retained upon the supporting rolls 32 and 38.

Figure 5:
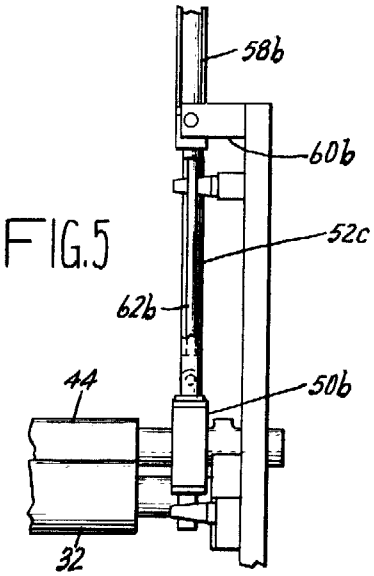
FIG. 5 is a partial view of the front elevation of FIG. 3 with the control panel thereof removed, showing one of the air cylinders which urges the riding roller into contact with the mandrel and the roll of material thereupon.

Referring now to FIGS. 1, 3, 4 and 5, a pair of pneumatic cylinders 58*a* and 58*b* are connected to one of the frame members 24 by brackets 60*a* and 60*b* respectively (FIGS. 3 and 5). Each of the pneumatic cylinders 58 includes a piston rod 62 (FIGS. 1 and 4), the piston rods 62*a* and 62*b* being connected respectively to the riding roller heads 50*a* and 50*b*.

Referring now to FIG. 1, the apparatus 20 includes seven feed rollers 64*a* – 64*g* which separate and guide three elongated sheets of paper 66*a* – 66*c*, sheet 66*a* being fed from payoff roll 68 and the sheets 66*b* and 66*c* being fed from similar payoff rolls (not shown).

Referring now to FIGS. 1 and 6, the apparatus 20 includes a cylindrically shaped slitting drum 70 having a plurality of longitudinally spaced circumferential slitting grooves 72 (FIG. 6) and having a pair of ends 74*a* and 74*b* which are rotatably mounted into the frame members 24*a* and 24*b* respectively by a pair of bearings 76*a* and 76*b*.

Referring now to FIGS. 1 and 6, the apparatus 20 includes a knife-mounting shaft 78 which is parallel disposed to the slitting drum 70 and which includes an end 80 which is mounted to the frame member 24*a* for rotational and reciprocating movement therein.

Figure 7:
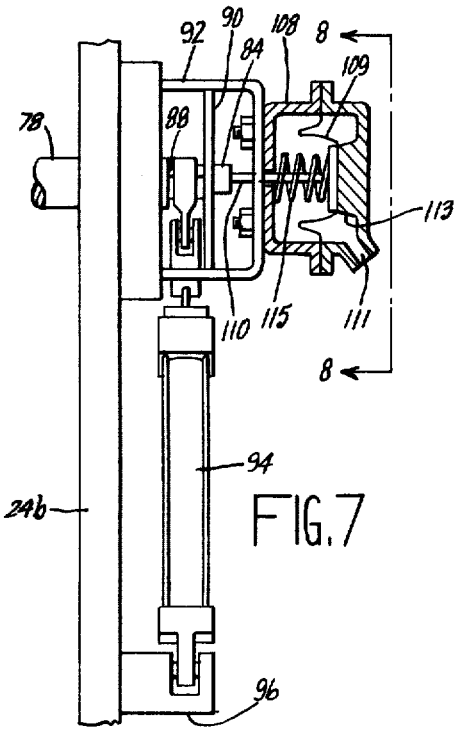
FIG. 7 is a partial and enlarged front elevation, taken the same as the FIG. 3 illustration, and more clearly showing the mechanism for moving the slitting knives into meshing engagement with the slitting drum and for moving one side of each of the slitting knives into operative engagement with the sides of the respective slitting grooves.
Figure 9:
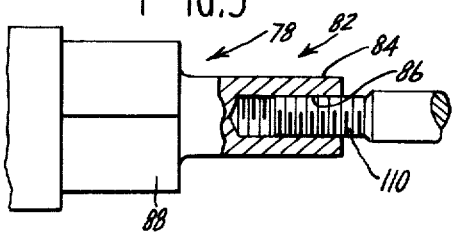
FIG. 9 is a partial and enlarged view of the knife-mounting shaft and the shaft of the linear pneumatic actuator, taken the same as the FIG. 7 illustration.

Referring now to FIGS. 7 and 9, the knife-mounting shaft 78 includes a second end 82. The second end 82 includes a cylindrical bearing portion 84 (FIG. 9) having a longitudinally disposed and threaded bore 86 therein, and a square portion 88 being adjacent to the bearing portion 84.

Referring now to FIG. 7, the bearing portion 84 (FIG. 9) is rotatably and reciprocally mounted in the plate 90 of a mounting bracket 92 which is in turn attached to the frame member 24*b*.

Figure 8:
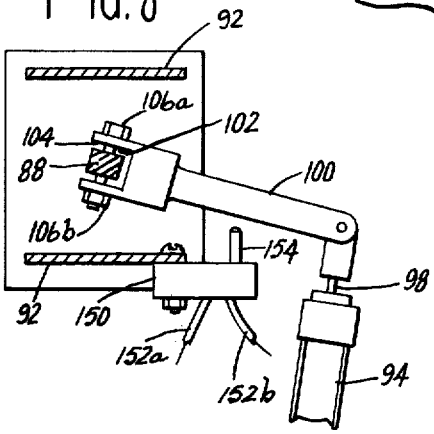
FIG. 8 is partial end view of one of the mechanisms of FIG. 7 taken as shown by view line 8—8 of FIG. 7.

Referring now to FIGS. 7 and 8, a means for angularly rotating and positioning of the knife-mounting shaft 78 and a means for longitudinally actuating the knife-mounting shaft 78 will be described. A pneumatic cylinder 94 is pivotally attached to the frame member 24*b* by a bracket 96. The pneumatic cylinder 94 includes a piston rod 98 which is attached to one end of a torque arm 100. The other end of the torque arm includes a slot 102 which provides a clevis 104 for straddling the square portion 88 of the knife-mounting shaft 78. The clevis 104 of the torque arm 100 is connected to the square portion 88 by a pair of set screws 106*a* and 106*b*.

Referring now to FIGS. 7 and 9, a linear pneumatic actuator 108 (FIG. 7) is connected to the mounting bracket 92 for mounting thereof. The linear pneumatic actuator 108 includes a threaded piston rod 110 which is threadably engaged with the threaded bore 86 of the knife-mounting shaft 78, the two threads being free to relatively rotate so that the pneumatic cylinder 94 and the torque arm 100 can rotate the knife-mounting shaft 78 without rotating the threaded piston rod 110.

The actuator 108 is pressure actuated by air pressure applied to a diaphragm 109 through a port 111 to move the knife-mounting shaft 78 toward the frame member 24*a* and is moved in the other direction to a stop 113 by a spring 115.

Referring now to FIGS. 1, 2 and 6, the purpose for rotating and for linearly actuating the knife-mounting shaft 78 will be shown. The knife-mounting shaft 78 includes a dovetail 112 (FIG. 2) which extends for a major portion of the length thereof as can be seen in the FIG. 6 illustration. A plurality of knife-mounting brackets 114 each includes a dovetail groove 116 which is slidably mounted onto the dovetail 112 and which serves for positioning and securing of the respective knife-mounting brackets 114 to the dovetail 112 of the knife-mounting shaft 78. Each of the knife-mounting brackets 114 includes a cutter arm mounting groove 118 which is disposed orthogonally to the longitudinal axis of the knife-mounting shaft 78. A plurality of slitting knife arms 120, each having an elongated slot 122 therethrough are adjustably attached to the knife-mounting brackets by respective ones of a plurality of securing bolts 124.

A plurality of disc-shaped slitting knives 126 are each rotatably attached to a distal end 128 of the slitting knife arms 120, the axis of rotation of the slitting knives 126 being parallel to the longitudinal axis of the slitting drum 70.

Referring now to FIG. 12, the annular slitting grooves 72 of the slitting drum each include a shearing side 117, an opposite side 119, and a bottom surface 121. The slitting knives 126 each include a shearing side 127, an opposite side 129, and a beveled outside diameter 131. As clearly shown in FIG. 12, the slitting grooves 72 have a width greater than the thickness of the slitting knives 126 so that the slitting knives 126 can be moved into and out of meshing engagement with the grooves 72 without any of the slitting knives 126 touching any of the respective sides 117 and 119.

Referring now to FIGS. 1 and 6, a mandrel 130 having a plurality of adjacent rolls of paper 133 wrapped thereon and having ends 132*a* and 132*b* (FIG. 6) is supportably received on the first supporting roller 32 and the second supporting roller 38 and the riding roller 44 is pressed into engagement with the mandrel 130 or with the rolls of paper 133 that are wrapped onto the mandrel 130.

Referring now to FIGS. 6, 10 and 11, a pair of bearings 134*a* and 134*b* have been mounted onto the ends 132*a* and 132*b* respectively. The bearing 134*a* is supportably received into a saddle 136*a* which is more clearly seen in FIGS. 10 and 11. The saddle 136*a* is rigidly attached to a piston rod 138*a* of a pneumatic cylinder 140*a*. The pneumatic cylinder 140*a* is attached to a mounting bracket 142*a* which is attached to the frame member 24*a*. In like manner, the end 132*a* of the mandrel 130 is supported by the bearing 134*b*, by a saddle 136*b* (not shown) like 136*a*, by a pneumatic cylinder 140*b* (not shown) like 140*a*, and by a mounting bracket 142*b* (not shown) like bracket 142*a*. The piston rod 138*a* is guidably supported by a guide bushing 144*a* and the piston rod 138*b* (not shown) for the other end of the mandrel 130 is supported in like manner (not shown). The saddle 136*a* includes a mandrel receiving recess 146*a* (FIG. 11) opening toward the end 132*a* of the mandrel 130 and a loading notch 148*a* which opens upwardly from the mandrel receiving recess 146*a*.

Referring now to FIG. 8, an electrical switch 150 having a pair of contacts 152*a* and 152*b* and an actuating plunger 154 is attached to the mounting bracket 92. The actuating plunger 154 is aligned to be engaged by and receive motion from the torque arm 100 and to thereby control electrical communication between the contacts 152*a* and 152*b* when the slitting knives 126 have penetrated into the slitting grooves 72 by a predetermined distance.

Referring now to FIG. 6, a first fluid motor 156, having a fixed fluid displacement per revolution includes a housing 158 which is attached to the frame member 24*a* by a mounting bracket (not shown). The fluid motor 156 includes a shaft 160 which is connected to the end 34*a* of the first supporting roller 32 by a coupling 162. In like manner, a second fluid motor (214 of FIG. 13) is connected (not shown) to the second supporting roller 38 and to the frame member 24*a*. A third fluid motor 166, having a fixed fluid displacement per revolution, includes a housing 168 which is attached to the riding roller head 50*b* and a shaft 170 which is connected to the end 46*b* of the riding roller 44.

Figure 13:
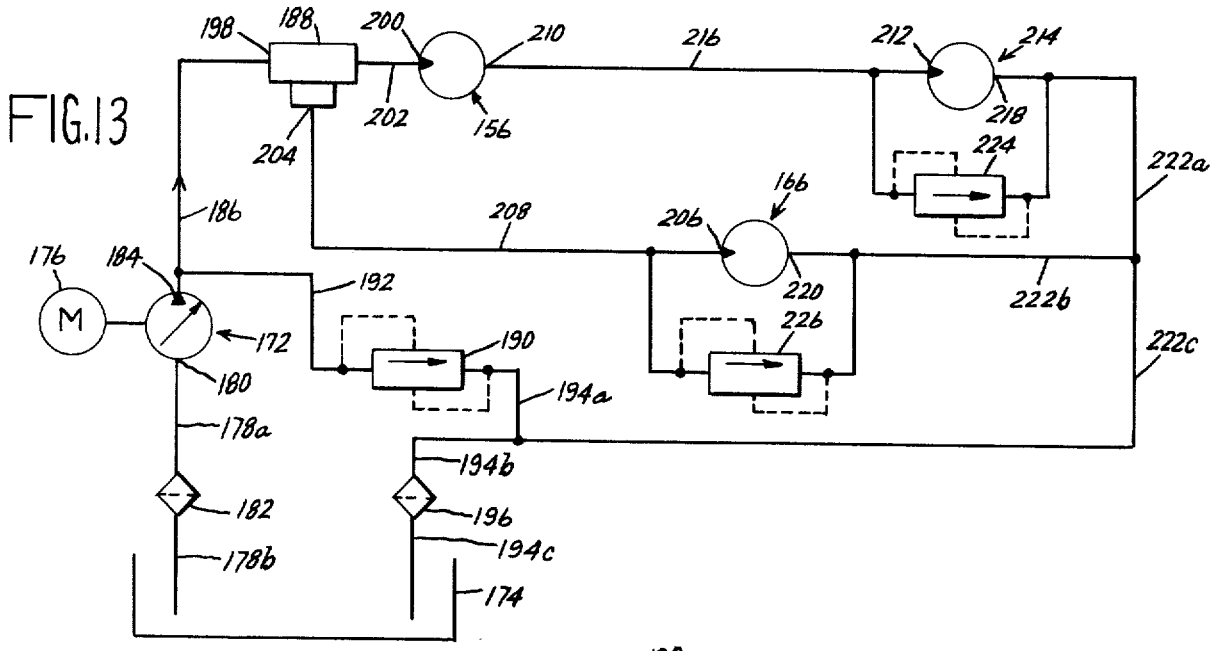
FIG. 13 is a schematic drawing of the hydraulic system which drives both of the supporting rollers and the riding roller.

Referring now to FIG. 13, the hydraulic system for the apparatus 20 includes a source of fluid pressure comprising a pump 172 having manually adjustable displacement and a sump 174, the pump 172 being driven by an electric motor 176. The hydraulic system of FIG. 13 includes inlet conduits 178*a* and 178*b* connecting sump or reservoir 174 with an inlet port 180 of the pump 172 and having a filter 182 being interposed between the conduits 178*a* and 178*b*.

The pump 172 includes an outlet port 184 which is connected by a conduit 186 to a flow divider 188 and to a pressure relief valve 190 by a conduit 192. The relief valve 190 is connected to the sump or reservoir 174 by conduits 194*a* – 194*c* and by a filter 196 which is interposed between the conduits 194*b* and 194*c*.

The flow divider 188 includes a first outlet port 198 which is connected to an inlet port 200 of the first fluid motor 156 by a conduit 202 and a second outlet port 204 which is connected to an inlet port 206 of the third fluid motor 166 by a conduit 208.

The first fluid motor 156 includes an outlet port 210 which is connected to an inlet port 212 of a second fluid motor 214 by a conduit 216. An outlet port 218 of the second fluid motor 214 and an outlet port 220 of the third fluid motor 166 are both connected to the sump or reservoir 174 by conduit 222 and 194.

A first manually adjustable pressure relief valve 224 is connected between the inlet port 212 and the outlet port 218 of the second fluid motor 214 to bypass excess fluid from the inlet port 212 to the reservoir 174 and to limit the torque of the second fluid motor 214 to predetermined and manually adjustable magnitude. In like manner, a second manually adjustable pressure relief valve 226 is connected between the inlet port 206 and the outlet port 220 of the third fluid motor 166 to bypass excess flow from the inlet port 206 to the sump or reservoir 174 and to limit the rotational torque of the third fluid motor 166 to predetermined and manually adjustable magnitudes.

Figure 14:
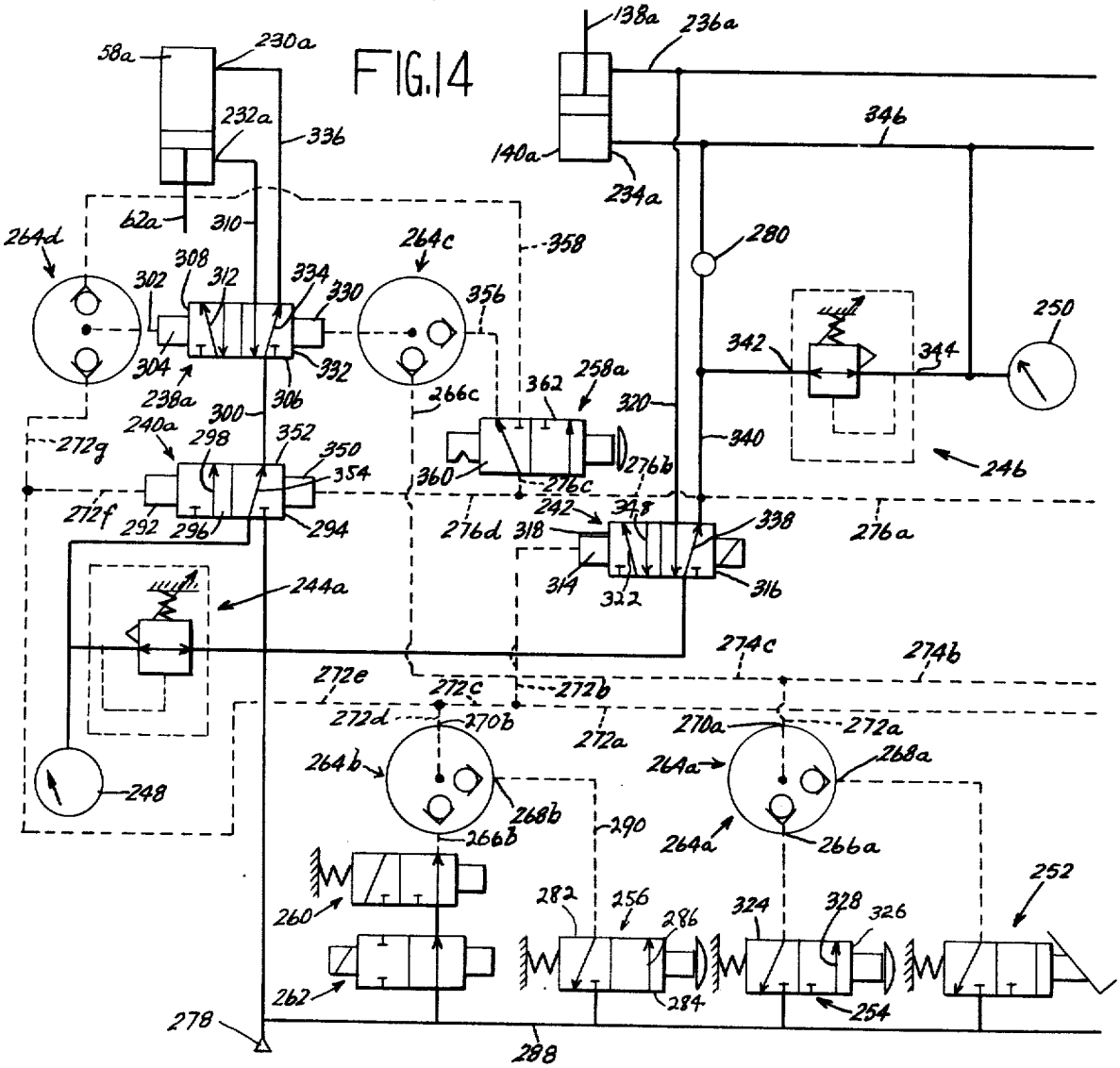
FIG. 14 is a schematic drawing of the pneumatic system for the apparatus.

Referring now to FIG. 14, the FIG. 14 illustration is a schematic drawing of the pneumatic circuit which is used for raising and lowering the riding roller 44 (FIG. 1) and for raising and lowering the saddles 136 (FIG. 6) which guide the mandrel 130.

The FIG. 14 schematic includes the pneumatic cylinder 58*a* and the piston rod 62*a* thereof which is connected to the riding roller head 50*a* (FIG. 1) and the pneumatic cylinder 140*a* which includes the piston rod 138*a* that is connected to the saddle 136*a* (FIG. 6). Thus only one each of the cylinders 58 and of the cylinders 140 are included in the schematic of FIG. 14. In like manner, where identical components and conduits are used for actuating the cylinders 58*b* and 140*b*, these identical conduits and components are omitted from the FIG. 14 illustration, the points of connection of the identical conduits and components being clearly illustrated.

The pneumatic cylinder 58*a* is shown in a vertical orientation with the piston rod 62*a* thereof depending therefrom as it is mounted on the apparatus 20 (FIG. 1). The pneumatic cylinder 58*a* includes a piston rod extending port 230*a* and a piston rod retracting port 232*a*. In like manner, the pneumatic cylinder 140*a* is shown in a vertical position with the piston rod 138*a* thereof extending upwardly therefrom as it is mounted on the apparatus 20 (FIG. 6). The pneumatic cylinder 140*a* includes a piston rod extending port 234*a* and a piston rod retracting port 236*a*.

The pneumatic system includes pilot-operated valves 238*a* and 240*a* which control the extending and retracting of the piston rod 62*a*, pilot and solenoid-operated valve 242 which controls the extending and retracting of both the pneumatic cylinder 140*a* and the pneumatic cylinder 140*b* (not shown), a pressure regulator 244*a* which controls the pneumatic pressures applied to the pneumatic cylinder 58*a*, a pressure regulator 246 which controls the pneumatic pressures applied to the pneumatic cylinders 140*a* and 140*b*, and a pair of pressure gauges 248 and 250 which respectively monitor the pneumatic pressures controlled by the pressure regulators 244*a* and 246.

The pneumatic system also includes pilot valves 252 and 254 which provide alternate controls for applying pneumatic pressure to the ports 230*a* and 230*b* (not shown) of the cylinders 58 and thereby to lower both of the ends 46 of the riding roller 44, a pilot valve 256 which may be actuated to apply pneumatic pressure to the ports 232*a* and 232*b* (not shown) of the pneumatic cylinders 58*a* and 58*b* and thereby to retract the piston rods 62 and to raise both of the ends 46 of the riding roller 44, a pilot valve 258*a* which selectively determines actuation of the pilot operated valve 238*a* to positions wherein the pneumatic cylinder 58*a* is raised and lowered, and pilot valves 260 and 262 which are series connected and which serve to retract the pneumatic cylinders 58*a* and 58*b* (not shown) and to raise the riding roller 44 when both the pilot valve 260 and 262 are moved to their respective positions wherein communication is made therethrough.

The pneumatic system of FIG. 14 also includes a plurality of shuttle valves 264 each having inlet ports 266 and 268 and each having an outlet port 270. The shuttle valves 264 are effective to accept a pilot input signal to either the inlet ports 266 or 268 and to deliver a pressure signal to the outlet port 270.

The pneumatic system of FIG. 14 includes three pilot pressure lines whose function should be understood before attempting to follow through the schematic of FIG. 14. One of these pilot lines is pilot line 272 which includes line portions 272*a* – 272*g* and which is pressurized to apply pneumatic pressure to the ports 232*a* and 232*b* (not shown) and thereby to retract the piston rods 62 of the cylinders 58 and to raise the riding roller 44. A second of these pilot lines is pilot line 274 which includes pilot line portions 274*a* – 274*c* and which is effective to move the pilot operated valves 238*a* and 238*b* (not shown) to positions wherein the pneumatic cylinders 58 are extended and the riding roller 44 is lowered. The third of the pilot lines is pilot line 276 which includes portions 276*a* – 276*d* and which is effective to move the pilot operated valve 240 to the position shown wherein pneumatic pressure applied to an air supply port 278 is reduced in pressure by passing through the pressure regulator 244*a* before being applied to the pneumatic cylinder 58*a*.

The only other component in the pneumatic system of FIG. 14 is a check valve 280. The check valve 280 cooperates with the pressure regulator 246 to allow free flow of air from the ports 234*a* and 234*b* (not shown) of the pneumatic cylinders 140*a* and 140*b* (not shown) to be exhausted by the valve 242 while preventing pressurized air from being supplied to the ports 234 except via the pressure regulator 246.

Having described the apparatus in some detail, the operation of the apparatus 20 will now be described. Referring to FIGS. 7, 8 and 12, pneumatic pressure is released from the linear pneumatic actuator 108 (FIG. 7) allowing the spring 115 therein to move the knife-mounting shaft 78 axially to the right against the stop 113 to a position wherein the slitting knives 126 (FIG. 12) are centered within the grooves 72 of the slitting drum 70. Then air is applied to the pneumatic cylinder 94 (FIG. 8) to extend the piston rod 98 thereof and to rotate the knife-mounting shaft 78 to a position wherein the slitting knives 126 (FIG. 12) are removed from meshing engagement with the slitting grooves 72 of the slitting drum 70.

Referring now to FIGS. 1, 3, 4, 5 and 6, pressurized air is applied to the cylinders 58*a* and 58*b* (FIG. 3) to retract the piston rods 62 thereof and to raise the riding roller heads 50 (FIGS. 4 and 5) and the riding roller 44 which is mounted therebetween. Then the mandrel 130 is removed from the supporting rollers 32 and 38. Next, the end of an elongated sheet of paper 66*a* (FIG. 1) is fed from the payoff roll 68*a*, around appropriate ones of the feed rollers 64, between the slitting drum and a plurality of the slitting knives 126, and over the supporting rollers 32 and 38. The mandrel 130 is then placed on top of the elongated sheet of paper 66*a* and into longitudinal supporting engagement with the supporting rollers 32 and 38. The end of the elongated sheet of paper 66*a* is then attached to the mandrel 130.

It should be understood that additional elongated sheets of paper 66 may also be fed around the appropriate ones of the feed roller 64, between the slitting drum 70 and the slitting knives 126 and across the supporting roller 32 and 38, if it is desired to slit multiple plies of paper and to wind a multi-ply roll of paper.

Next the pneumatic cylinders 58*a* and 58*b* are pressurized to extend the piston rods 62*a* and 62*b* and thereby to lower the riding roller 44 into longitudinal contact with the mandrel 130.

Referring now to FIG. 6, pressurized air is not applied to the pneumatic cylinders 140*a* and 140*b* (not shown) to extend the piston rods 138*a* and 138*b* (not shown) and thereby to raise the saddles 136*a* and 136*b* (not shown) into guiding alignment with the bearings 134*a* and 134*b* of the mandrel 130, the pressure magnitude of the air pressure being controlled by the pressure regulator 246 (FIG. 14) to a value wherein the cylinders 140 are not able to raise the mandrel 130 from the supporting rollers 32 and 38 against the opposition of the force supplied to the riding roller 44 by the cylinders 58.

Referring now to FIGS. 1, 2, 7, 8 and 12, the pneumatic cylinder 94 (FIGS. 7 and 8) is now pressurized to retract the piston rod 98 thereof and thereby to rotate the torque arm 100 which in turn rotates the knife-mounting shaft 78 to a position wherein the slitting knife arms 120 (FIG. 2) move the slitting knives 126 into meshing engagement with the grooves 72 (FIG. 12) of the slitting drum 70. When the torque arm 100 engages the plunger 154 of the electric switch 100, the cylinder 94 is locked against further movement by controlling the supply of pressurized air thereto, and pressurized air is supplied to the linear actuator 108 (FIG. 7) to move the knife-mounting shaft 78 to the left and thereby to move the shearing sides 127 (FIG. 12) of the slitting knives 126 into operative engagement with the shearing sides 117 of the slitting groove 72, the pneumatic pressure that is applied to the linear actuator 108 being regulated to provide resilient contact between the shearing sides 117 and 127.

The machine is now ready to operate the supporting roller 32 is rotated in a clockwise direction (FIG. 1) at a predetermined rotating speed, the supporting roller 38 is supplied with a predetermined rotational torque in a clockwise direction, and the riding roller 44 is supplied with a predetermined rotational torque in a clockwise direction. The rotational torques, being applied to the supporting roller 38 and to the riding roller 44, are limited to values wherein the total torque applied to both the supporting roller 38 and to the riding roller 44 is less than the total required to propel the paper, to slit the paper and to wind the paper so that a portion of the total required torque is supplied to the supporting roller 32. Since the supporting roller 32 is driven by a fluid motor which is supplied with a predetermined fluid flow, the supporting roller 32 can provide torque only up to a predetermined speed, and since the supporting roller 38 and the riding roller 44 can only provide a portion of the total required torque, the supporting roller 38 and the riding roller 44 can rotate only at the speed at which the supporting roller 32 can assist in providing the total torque. Thus all of the rollers 32, 38 and 44 rotate at peripheral speeds substantially equal to that which is determined by the peripheral speed of the supporting roller 32 and the corresponding linear speed of the paper 66.

Referring now to FIGS. 1 and 6, to remove the completed roll of paper from the machine, the rotation of the supporting rollers 32 and 38 (FIG. 1) and the riding roller 44 is first stopped. Then the pneumatic cylinders 58 are retracted to raise the riding roller 44 from the roll of paper 133 that is wrapped on the mandrel 130, and the pneumatic cylinders 140 (FIG. 6) are retracted to pull the saddles 136 downward from supporting engagement with the bearings 134 of the mandrel 130. The completed roll of material and the mandrel 130 can now be removed and another mandrel placed into the manchine.

Referring now to FIG. 13, the operation of the hydraulic system is as follows: the pump 172 receives fluid from the sump 174 and delivers pressurized fluid to the flow divider 188. The flow divider 188 divides the pressurized fluid from the pump 172 into two proportional flows. One of the proportional flows is delivered through the outlet port 198 to the inlet port 200 of the first fluid motor 156. The other of the proportional flows is delivered from the outlet port 204 to the inlet port 206 of the fluid motor 166. Thus it can be seen that the flow divider 188 must divide the total output of the pump 172 into respective proportions wherein a sufficient quantity of fluid is provided to the fluid motor 166 to rotate the fluid motor 166 at a rotational speed wherein the peripheral velocity of the riding roller attached thereto would exceed the peripheral velocity of the supporting roller 38 (FIG. 1) which is attached to the first fluid motor 156. Thus by attaching the relief valve 226 in bypassing relationship to the third fluid motor 166, the excess flow being provided to the fluid motor 166 may be bypassed at a predetermined pressure, and the riding roller 44 attached thereto will rotate at a peripheral speed substantially equal to that of the first supporting roller 32 and to the linear velocity of the sheet of paper 66.

Fluid being discharged from the first fluid motor 156 is supplied to the inlet port 212 of the second fluid motor 214. The second fluid motor 214 has a smaller displacement than the fluid motor 156 so that the first fluid motor 156 supplies an excess of fluid to the fluid motor 214 above that which would be required to rotate the second supporting roller 38 (FIG. 1) at a peripheral velocity equal to that of the first supporting roller 32. The pressure relief valve 224 is connected to bypass excess fluid from the inlet port 212 of the second fluid motor 214 to the sump 174 at a predetermined bypass pressure. Thus the torque output of the fluid motor 214 is limited to a predetermined value and the rotational velocity of the motor 214 is controlled to a value wherein the peripheral speed of the second supporting roller 38 is governed by the peripheral speed of the first supporting roller 32 and the linear velocity of the paper 66.

Referring now to FIG. 14, the operation of the pneumatic system will be described. First, raising the riding roller, the pilot valve 256 is operated from a position 282 as shown to a position 284 wherein a flow path 286 connects a supply conduit 288 to a pilot line 290 to supply pressurized air to an inlet port 268*b* of a shuttle valve 264*b*. This air being delivered to the inlet port 268*b* is transmitted to the pilot lines 272 by the shuttle valve 264*b*, and the pressurized air in the pilot lines 272 is delivered to an operator 292 of the pilot-operated valve 240*a* and a shuttle valve 264*d*. The air which is supplied to the operator 292 of the pilot-operated valve 240*a* is effective to move the valve 240*a* from a position 294 as shown to a position 296 wherein a flow path 298 delivers pressurized air from the supply conduit 288 to a conduit 300. At the same time the pressurized air in the pilot lines 272 and the shuttle valve 264*d* has been supplied to a pilot line 302 and to an operator 304 of the pilot-operated valve 238*a*, moving the valve 238*a* from a position 306 as shown to a position 308 wherein the conduit 300 is connected to a conduit 310 by a flow path 312 in the valve 238*a* thereby applying pressurized air from the supply conduit 288 to the retracting port 232*a* of the pneumatic cylinder 58*a*.

The pressurizing of the pilot lines 272 by the actuation of the pilot valve 256 to the position 284 is also effective to supply pressurized air to an operator 314 of the pilot-operated valve 242, moving the valve 242 from a position 316 as shown to a position 318 wherein pressurized air is supplied from the supply conduit 288 to a conduit 320 via a flow path 322 in the valve 242, thereby applying pressurized air to the retracting ports 236*a* and 236*b* (not shown) of the pneumatic cylinders 140 and retracting the piston rods 138 to lower the saddles 136*a* (FIG. 10 and 11) and 136*b* (not shown).

Referring again to FIG. 14, moving of the riding roller 44 (FIGS. 4 and 5) downward is as follows: the pilot valves 252 and 254 are provided for optionally lowering the riding roller 44 by hand-actuation of the pilot valve 254 or by foot-actuation of the pilot valve 252. Since the valves 252 and 254 are identical in operation, only one of them will be described. When the pilot valve 254 is moved, from a position 324 as shown to a position 326, a flow path 328 connects the conduit 288 with the inlet port 266*a* of the shuttle valve 264*a* thereby applying pressurized air to the pilot lines 274. Pressurized air in the pilot lines 274 is supplied to an inlet port 266*c* of a shuttle valve 264*c* and then to an operator 330 of the pilot-operated valve 238*a*, moving the valve 238*a* to a position 332 (as shown) wherein a fluid flow path 334 connects the conduit 300 to a conduit 336 and to the extending port 230*a* of the pneumatic cylinder 58*a* to lower the riding roller 44 (FIG. 1).

Referring again to FIG. 14, whenever the pilot and solenoid-operated valve 242 is in the position 316 (as shown), a fluid flow path 338 connects the supply conduit 288 to a conduit 340. Supplying pressurized air to the conduit 340 is effective to supply pressurized air to an inlet port 342 of the pressure regulator 246 and to supply air at a reduced pressure from an outlet port 344 of the pressure regulator 246 to the extending ports 234 of the pneumatic cylinders 140 by way of a conduit 346. Thus air pressure at a reduced pressure magnitude is supplied to the extending ports 234 of the cylinders 140 to resiliently urge the piston rods 138 upward and thereby to resiliently hold the saddles 136*a* (FIGS. 10 and 11) and 136*b* (now shown) into guiding contact with the bearings 134 (FIG. 6) of the mandrel 130.

It should be noted that the check valve 280 prevents the pressure in the conduit 340 from being applied to the extending ports 234 of the pneumatic cylinders 140 without the pressure magnitude of the air pressure first being reduced by flowing through the pressure regulator 246, but the check valve 280 permits free flow of air from the ports 234 to the atmosphere via the flow path 348 when the valve 242 is in the position 318.

Referring again to FIG. 14, it has been shown that the pilot lines 276 are pressurized from the supply conduit 288 by way of the flow path 338 of the valve 242 and by the conduit 340 whenever the valve 242 is in the position 316. It can be seen that this pressurizing of the pilot lines 276 occurs at the time that the conduit 340 is supplying air to the pressure regulator 246 and the pressure regulator 246 is supplying air at a reduced pressure to the conduit 346 and to the ports 234 of the pneumatic cylinders 140 to resiliently urge the saddles 136 into guiding alignment with the mandrel 130. Thus it can be understood that the pilot lines 276 are pressurized when the apparatus 20 is in operation.

The functioning of the pressurized air in the pilot lines 276 is as follows: pressurized air in pilot lines 276 is applied to an operator 350 of the pilot-operated valve 240*a*, moving the valve 240*a* to a position 352 (as shown) wherein a fluid flow path 354 is established connecting the supply conduit 288 to the conduit 300 by way of the pressure regulator valve 244. Thus, during operation of the machine, the air pressure being applied to the pneumatic cylinder 58*a* by way of the conduits 288 and 300, is adjustably reduced by the pressure regulator 244*a*. In like manner, another manually adjustable pressure regulator 244*b* (not shown) is supplied to manually ajust and to control the pressure magnitude of the pressure being applied to an extending port 230*b* (not shown) of the pneumatic cylinder 58*b*

Finally, referring to FIG. 14, the functioning of the pilot valve 258*a* will be described. It was shown that the pilot lines 276 are pressurized whenever the apparatus 20 is in operation. Thus pressurized air is selectively supplied to pilot lines 356 and 358 when the pilot valve 258*a* is in positions 360 and 362, respectively. When pressurized air is supplied to pilot line 358, pressurized air is supplied to the operator 304 of the valve 238*a* by way of the shuttle valve 264*d*, moving the valve 238*a* to the position 308 wherein pressurized air is supplied from the conduit 300 to the conduit 310 to retract the cylinder 58*a*. In like manner, when pressurized air is furnished to the pilot line 356, pressurized air is furnished to the operator 330 by way of the shuttle valve 264*c*, moving the valve 238*a* to the position 306 wherein the conduit 300 is connected to the conduit 336 and to the port 230*a* of the cylinder 58*a* by way of the flow path 334 to extend the cylinder 58*a*. Thus, it can be seen that the pilot valve 258*a* can be actuated to selectively apply pressure to the extending port 230*a* or to the retracting port 232*a* of the pneumatic cylinder 58*a*.

Thus it can be seen that the pressure regulator 244*a* and the pilot valve 258*a* cooperate to adjustably and selectively control the magnitude and the direction of the force produced by the pneumatic cylinder 58*a* and thereby to adjustably and selectively increase or decrease the initial or gravitational force of the weight of the riding roller head 50*a* and one-half of the weight of the riding roller 44.

In like manner, the initial or gravitational force of the riding roller head 50*b* and of the other half of the riding roller 44 is adjustably and selectively increased or decreased by the pneumatic cylinder 58*b*, the pressure regulator 244*b* (not shown) and the pilot valve 258*b* (not shown).

While there have been described above the principles of this invention in connection with specific apparatus, it is to be clearly understood that this description is made only by way of example and not as a limitation to the scope of the invention.

What is claimed is:

1. An apparatus for winding elongated sheets of material into rolls, which comprises:

a. a mandrel having a length greater than the width of the material to be rolled;

b. supporting roller means, comprising a pair of parallel-disposed supporting rollers each having a length greater than the width of the material to be rolled and each being rotatably mounted for rotation about the respective longitudinal axes thereof, for supporting said mandrel upon both of said rollers and in parallel disposition to both of said rollers, for receiving the material to be rolled between a first of said supporting rollers and said mandrel, and then for receiving the material between the second of said supporting rollers and said mandrel;

c. riding roller means comprising a riding roller having a length greater than the width of the material to be rolled, being rotatably and reciprocably mounted at opposite ends thereof for rotation about the axis thereof, for guiding said riding roller to a first position wherein said riding roller is in longitudinal surface contact with said mandrel distal from said supporting rollers when said mandrel is in longitudinal surface contact with said supporting rollers, for guiding and riding roller distally from said supporting rollers and said mandrel to a plurality of positions wherein the axis of said riding roller is substantially parallel to the axes of said supporting rollers and wherein the axis of said riding roller is disposed aroung the axis of said mandrel by an angle less than 180 degrees from the longitudinal axis of either of said supporting rollers, and for receiving the material to be rolled between said riding roller and said mandrel after said material passes between said second supporting roller and said mandrel;

d. drive means being operably connected to said first supporting roller for imparting a predetermined rotational speed thereto for receiving the material to be rolled between said first supporting roller and said mandrel and then for transporting the material toward said second supporting roller, and being connected to one of the other of said rollers for applying a force to said other roller to rotate said other roller at a rotational speed a predetermined amount higher than the rotational speed of said first roller and including means for limiting the force applied to said other roller to a predetermined maximum so that said paper is protected against excessive tensional forces on said sheet material between said rollers;

e. rider roll forcing means being operatively connected to said riding roller means, for resiliently forcing of both ends of said riding roller in a plane substantially orthogonal to the plane through the axes of said supporting rollers, and for controlling the forcing of said riding roller toward and away from said mandrel and said supporting rollers; and f. guide means for retaining said mandrel between said supporting rollers and said riding roller and for allowing said mandrel to move from said supporting rollers as material is rolled onto said mandrel.

2. The apparatus of claim 1 in which said drive means is operably connected to the third of said rollers for rotating said third roller in the same direction as said supporting roller.

3. The apparatus of claim 1 in which said other roller comprises said second supporting roller, and said drive means is operably connected to said riding roller for applying a predetermined rotational torque to said riding roller in the same direction aas the first said predetermined rotational torque.

4. The apparatus of claim 3 in which said drive means includes torque adjusting means for manually adjusting the torque magnitude of one of said predetermined rotational torques.

5. The apparatus of claim 4 in which said drive means includes torque measuring means for visual reading of said torque magnitude.

6. The apparatus of claim 1 in which said drive means comprises a source of pressurized fluid that includes a pump and a sump, said connection of said drive means to said first supporting roller comprises a first fixed displacement fluid motor being operably connected thereto, said connection of said drive means to said other roller comprises a second fixed displacement fluid motor being operably connected thereto, said fluid motors are series connected whereby said second fluid motor is operated by fluid exahusted by said first fluid motor, and said fluid motors are sized to provide a greater peripheral speed to said other roller for a given flow rate than to said first supporting roller, said source includes means for delivering pressurized fluid to said first fluid motor at a predetermineed rate of fluid flow, and a pressure relief valve being connected to bypass fluid around said second fluid motor at a predetermined pressure magnitude provides said predetermining of said rotational torque, whereby said first motor will rotate said first supporting roller at said predetermined rotational speed in accordance with said predetermined fluid flow rate, and said fluid motors share the total torque requirements of conveying and winding of material in accordance with said predetermined pressure magnitude of said pressure relief valve whenever said predetermined pressure magnitude is less than the value which would provide said total torque by said second fluid motor.

7. The apparatus of claim 6 in which said source includes means for manually adjusting said predetermined rate of fluid flow.

8. The apparatus of claim 6 in which said pressure relief valve is manually adjustable.

9. The apparatus of claim 8 in which said drive means includes a pressure gauge being operatively connected to said second fluid motor to visually determine said predetermined rotational torque.

10. The apparatus of claim 1 in which said drive means includes a source having a pump and a sump, said connection of said drive means to said first supporting roller comprises a first fluid motor being operably connected thereto, said connection of said drive means to said other roller comprises a second fluid motor being operably connected to said second supporting roller, and said drive means includes a third fluid motor being operably connected to said riding roller for applying a predetermined rotational torque thereto in the same direction as the first said predetermined rotational torque.

11. The apparatus of claim 10 in which all three of said fluid motors are of the fixed displacement type and said drive means includes means for supplying pressurized fluid to said first fluid motor at a predetermined flow rate whereby said predetermined rotational speed is determined thereby, for supplying pressurized fluid to said second fluid motor at a flow rate in excess of that required to rotate said second supporting roller at a peripheral speed equal to that of said first supporting roller, and for supplying pressurized fluid to said third fluid motor at a flow rate in excess of that required to rotate said riding roller at a peripheral speed equal to that of said first supporting roller, and said drive means includes pressure-limiting means for limiting the pressure magnitude of said pressurized fluid applied to said second and third fluid motors a value wherein the total torque developed by said second and third fluid motors is less than the total required to convey and to wind said material, whereby said predetermined torques are determined thereby, and whereby said second supporting roller and said riding roller rotate at speeds wherein the respective peripheral speeds thereof are substantially equal to that of said first supporting roller and the linear speed of the paper being conveyed therebetween.

12. The apparatus of claim 11 in which said pressure limiting means comprises a first manually adjustable pressure relief valve being connected to said second fluid motor and to said sump, and a second manually adjustable pressure relief valve being connected to said third fluid motor and to said sump.

13. The apparatus of claim 1 in which said rider-forcing means includes a first manually adjustable rider forcing mechanism for resiliently forcing one end of said riding roller, and a second manually adjustable rider-forcing mechanism for resiliently forcing the other end of said riding roller.

14. The apparatus of claim 13 in which said rider forcing mechanisms are remotely adjustable at a control panel.

15. The apparatus of claim 13 in which said rider-forcing mechanisms comprise fluid power cylinders.

16. The apparatus of claim 1 in which the longitudinal axes of said supporting rollers are in a horizontal plane, said riding roller means is disposed above said supporting rollers with the weight thereof providing an initial forcing of said riding roller toward said supporting rollers, and said rider-forcing means is selectively adjustable to provide forces adding to or substracting from said initial forcing.

17. The winding apparatus of claim 1 in which said apparatus further includes paper slitting means comprising a cylindrical slitting drum that is rotatably mounted about the longitudinal axis thereof and parallel to said first supporting roller and that includes a plurality of longitudinally disposed circumferential slitting grooves thereupon, a plurality of disc-shaped slitting knives being rotatably mounted with the axes thereof parallel to the longitudinal axis of said slitting drum and with said slitting knives operatively engaged with corresponding ones of said slitting grooves.

18. The apparatus of claim 17 in which said operative engagement of said slitting knives with said grooves includes meshing engagement of said slitting knives with respective slitting grooves and forceable contact to one side of each of said slitting knives with one side of said respective slitting grooves, and said apparatus includes means for longitudinally moving each of said slitting knives away from contact with said one side of the respective slitting grooves, for moving said slitting knives from meshing engagement from said slitting grooves, and for moving said slitting knives back into operative engagement with said grooves.

19. The apparatus of claim 17 in which said apparatus includes a frame:

a. said rotatable mounting of the three said rollers comprises a plurality of bearings each supportably mounting one end of each of said rollers to said frame;

b. said rotatable mounting of said slitting drum comprises a pair of bearings each supportably mounting one end of said slitting drum to said frame; and c. said rotatable mounting of said slitting knives comprises a knife-mounting shaft being mounted to said frame in parallel relationship to the longitudinal axis of said slitting drum, and a plurality of slitting knife arms each having a first end thereof attached orthogonally to the longitudinal axis of said knife-mounting shaft and each having one of said slitting knives pivotally attached to the distal end thereof.

20. The apparatus of claim 19 in which said apparatus includes means for rotating said knife-mounting shaft to a first angular position wherein said slitting knives are meshed with respective ones of said circumferential grooves and to a second angular position wherein said slitting knives are withdrawn from said circumferential grooves, and means for longitudinally actuating said knife-mounting shaft and resiliently forcing one edge of each of said slitting knives into operative engagement with one side of each of the respective grooves, and for longitudinally actuating said knife-mounting shaft to a position wherein said slitting knives may be moved into meshing engagement and out of meshing engagement with said grooves without either edge of any of said knives engaging either side of the respective grooves.

21. The apparatus of claim 20 in which said shaft-rotating means comprises a reciprocating fluid motor and a mechanism linkage being operatively connected to said knife-mounting shaft and to said frame and said longitudinal actuating means comprises a liner fluid motor being operatively connected to said knife-mounting shaft and to said frame.

22. The apparatus of claim 21 in which said operative connection of said linear fluid motor to said knife-mounting shaft comprises thread means for transferring axial motion therebetween and for allowing rotary motion therebetween.

23. The apparatus of claim 1 in which said guide means comprises a pair of reciprocating fluid motors each being mounted proximal to respective ends of said mandrel in a plane orthogonally bisecting the plane between the longitudinal axes of said supporting rollers, and each including means for supportably receiving one end of said mandrel.

24. The apparatus of claim 23 in which said longitudinal axes of said supporting rollers are in a horizontal plane and said means for supportably receiving one end of said mandrel comprises a saddle being attached to a respective one of said reciprocating motors, having a mandrel-receiving recess that opens toward said mandrel, and having a loading notch that opens distal from said supporting rollers.

25. The apparatus of claim 1 in which said apparatus includes a frame having a first vertical frame member proximal to one end of said supporting rollers and substantially orthogonal thereto, and having a second vertical frame member proximal to the other end of said supporting rollers and substantially orthogonal thereto:

a. said supporting rollers are disposed with the longitudinal axes thereof in a horizontal plane, and said rotatable mounting thereof comprises a bearing each being attached to one end of said supporting rollers and to the proximal one of said frame members;

b. said mandrel is disposed on top of said supporting rollers;

c. said rotatable and reciprocable mounting of said riding roller comprises first and second riding roller heads each being slidably mounted to the proximal one of said frame members by a pair of parallel spaced and vertically disposed guide rods, each having a bearing therein that is attached to one end of said riding roller, each being movable vertically to move said bearings and said mandrel from said first position to said second position, and both cooperating with said riding roller to gravitationally provide an initial force urging said riding roller toward said supporting rollers;

d. said rider-forcing means comprises a pair of pneumatic cylinders being vertically disposed at opposite ends of said riding roller and each being attached to one of said frame members and to one of said riding roller heads, and pressure regulator and valve means for adjustably and selectively controlling said resilient forcing of the ends of said riding roller toward or away from said mandrel, thereby adjustably and selectively increasing or decreasing said initial force;

e. said guide means comprises a pair of saddles each having a mandrel receiving recess opening toward a respective one end of said mandrel and each having a loading notch opening upwardly from said mandrel receiving recess, a pair of vertically disposed pneumatic cylinders each having the upper end thereof connected to one of said saddles and each having the lower end thereof operatively connected to a respective one of said frame members, and means for selectively and adjustably applying air pressure to said pneumatic cylinders to resiliently urge said saddles into guiding engagement with the respective ends of said mandrel;

f. said operable connection of said drive means to said first supporting roller comprises a first fixed displacement fluid motor having an inlet port and an outlet port, being operably connected to said first supporting roller, and being effective to rotate said first supporting roller at said predetermined rotational speed and at a predetermined peripheral velocity for a given fluid flow rate;

g. said operable connection of said drive means to said other roller comprises a second fixed displacement fluid motor having an inlet port and an outlet port, being operably connected to said second supporting roller, and being effective to rotate said second supporting roller at a peripheral velocity greater than said predetermined peripheral velocity for said given flow rate;

h. said operable connection of said drive means to said other roller comprises a second fixed displacement fluid motor having an inlet port and an outlet port, being operably connected to said second supporting roller, and being effective to rotate said second supporting roller at a peripheral velocity greater than said predetermined peripheral velocity for said given flow rate;

i. said drive means comprises a third fixed displacement fluid motor having an inlet port and an outlet port and being operatively connected to said riding roller, a pump having a manually adjustable displacement, a sump being connected to said pump to supply fluid thereto, a flow divider being connected to said pump to receive pressurized fluid therefrom and having first and second outlet ports being connected to respective inlet ports of said first and said third motors for proportionally delivering the output of said pump to said first and third motors at flow rates wherein an excess of flow is delivered to said third motor above that required to rotate said riding roller at the same peripheral velocity as said first supporting roller, a first conduit connecting said outlet port of said third fluid motor to said sump, a first manually adjustable pressure relief valve being connected between said inlet and outlet ports of said third fluid motor to bypass excess fluid from said inlet port thereof to said sump and to adjustably control said predetermined rotational torque, a second conduit connecting said outlet port of said first motor to said inlet port of said second motor, a third conduit connecting said outlet port of said second motor to said sump, a second manually adjustable pressure relief valve being connected between said inlet and outlet ports of said second fluid motor to bypass excess fluid from said inlet port to said sump and to adjustably control said predetermined torque, and a third pressure relief valve being operably connected to said pump and to said sump to limit the maximum pressure output of said pump;

j. a slitting drum being parallel disposed to said first supporting roller, being distal from both said second supporting roller and said riding roller, and having first and second ends thereof rotatably mounted to respective ones of said frame members;

k. a plurality of longitudinally spaced circumferential slitting grooves on said slitting drum each having a shearing side and an opposite side;

l. a knife-mounting shaft being parallel disposed to said slitting drum and distal from said rollers, having first and second ends operably mounted to respective ones of said frame members for rotational and reciprocal movement, and having a longitudinally disposed dovetail projecting from a portion of the length thereof;

m. a plurality of knife-mounting brackets each having a dovetail groove therein sized to fit said dovetail, each having means for selectively positioning and securing said dovetail groove relative to said dovetail, and each having an arm-mounting groove disposed orthogonally to said dovetail groove;

n. a plurality of slitting knife arms each having one end thereof attached to one of said arm-mounting grooves and each having a distal end;

o. a plurality of disc-shaped slitting knives each having a shearing side and an opposite side, each having a thickness less than the width of the respective ones of said slitting grooves, and each being attached to the distal end of one of said slitting knife arms with the longitudinal axis thereof parallel to the longitudinal axis of said slitting drum;

p. means including a torque arm and a pneumatic cylinder for rotating said knife-mounting shaft from a meshing position wherein said knives are engaged with respective ones of slitting grooves to a second position wherein said knives are spaced from said slitting drum; and q. means including a linear pneumatic actuator for longitudinally actuating said knife-mounting shaft to a longitudinal position wherein both said sides of said knives are spaced from engagement with the proximal sides of the corresponding slitting grooves, and for longitudinally actuating and resiliently urging the shearing sides of each of said knives into operative engagement with the shearing sides of the respective ones of said slitting grooves.

26. A method of winding an elongated sheet of material into a roll comprising the steps of:

a. extending one end of the material across the top of a first of a pair of parallel spaced supporting rollers and then across the second of the supporting rollers;

b. placing a mandrel upon said supporting rollers in parallel and longitudinal surface-supporting relationship thereto and with the material between the mandrel and the supporting rollers;

c. securing the one end of the material to the mandrel;

d. moving a riding roller into longitudinal surface contact with the mandrel distal from the supporting rollers;

e. rotating the first supporting roller at a predetermined speed in the direction that draws the material between the first supporting roller and the mandrel and then delivers the material between the other of the supporting rollers and the mandrel to make a roll of material on the mandrel;

f. applying a rotational force to another of said rollers sufficient to rotate said other roller at a rotational speed higher than the rotational speed of said first roller thereby providing tensioning of the sheet material on the mandrel between the first supporting roller and said other roller, limiting the rotational force applied to said other roller to a predetermined maximum thereby protecting against excessive tensional forces in said sheet material between said rollers;

g. guiding the mandrel to allow same to move away from the supporting rollers to make room for the roll of material being formed, and to hold the roll being formed in longitudinally contacting alignment with the supporting rollers and with the riding roller; and h. resiliently urging the riding roller against the roll of material being formed as the riding roller is moved away from said mandrel by the roll of material being formed.

27. The method of claim 26 in which said method further comprises manually adjusting said predetermined torque.

28. The method of claim 27 in which said method further comprises applying a predetermined rotational torque to the third of the rollers in the direction that provides tensioning of the material passing between the first supporting roller and the mandrel, whereby the third roller rotates at a peripheral speed substantially equal to that of the first supporting roller.

29. The method of claim 28 in which said method further comprises manually adjusting said second predetermined torque.

30. The method of claim 26 in which said method further comprises manually adjusting the force magnitude of the resilient urging of the riding roller against the roll of material being formed to selectively adjust the density of the roll being formed.

31. The method of claim 26 in which said method further comprises manually adjusting the force magnitude of the resilient force urging one end of the riding roller against the roll of material being formed to selectively correct for non-uniformity of winding.

* * * * *

UNITED STATES PATENT OFFICE

CERTIFICATE OF CORRECTION

Patent No. 3,944,150 Dated March 16, 1976

Inventor(s) Brian M. Jennerjahn

It is certified that error appears in the above-identified patent and that said Letters Patent are hereby corrected as shown below:

IN THE SPECIFICATION

| | |
|---|---|
| Col. 9, line 24 | "not" should be --now-- |
| Col. 9, line 44 | "electric" should be --electrical-- |
| Col. 10, line 24 | "manchine" should be --machine-- |

IN THE CLAIMS

| | |
|---|---|
| Claim 1, col. 13, line 39 | "and" should be --said-- |
| Claim 1, col. 13, line 44 | "aroung" should be --around-- |
| Claim 3, col. 14, line 17 | "aas" should be --as-- |
| Claim 11, col. 15, line 23 | --to-- should be inserted between "motors" and "a" |

Signed and Sealed this twenty-ninth Day of June 1976

[SEAL]

Attest:

RUTH C. MASON
Attesting Officer

C. MARSHALL DANN
Commissioner of Patents and Trademarks